US005822897A

United States Patent [19]

Ertzan

[11] Patent Number: 5,822,897

[45] Date of Patent: Oct. 20, 1998

[54] COMBINATION GREETING CARD PHOTOGRAPH FRAME AND ENVELOPE

[76] Inventor: Michelle Ertzan, 1595 Viewsite Dr., Los Angeles, Calif. 90069

[21] Appl. No.: 708,554

[22] Filed: Sep. 6, 1996

[51] Int. Cl.[6] ..... G09F 1/00

[52] U.S. Cl. ..... 40/124.09; 40/124.19; 40/748; 229/92.8

[58] Field of Search ..... 40/124.01, 124.09, 40/124.15, 124.16, 124.19, 124.191, 748, 750, 752, 774, 775, 786, 788, 100, 152.1, 155; 229/92.8

[56] References Cited

U.S. PATENT DOCUMENTS

| | | | |
|---|---|---|---|
| 1,426,649 | 8/1922 | Karr | 40/788 |
| 1,486,652 | 3/1924 | Froelich | 40/750 |
| 1,521,940 | 1/1925 | Gilmore | 40/124.15 |
| 1,602,583 | 10/1926 | Lawrence | 40/752 |
| 1,875,804 | 9/1932 | Dicicco | 229/92.8 X |
| 1,987,111 | 1/1935 | Kellermeier | 40/750 |
| 2,247,150 | 6/1941 | Chilcote | 40/775 |
| 2,410,858 | 11/1946 | Auger | 229/92.8 X |
| 3,355,828 | 12/1967 | Betz | 40/750 |

*Primary Examiner*—Kenneth J. Dorner
*Assistant Examiner*—Andrea Chop
*Attorney, Agent, or Firm*—Blakely Sokoloff Taylor & Zafman

[57] ABSTRACT

A self-contained, built-in and reversible greeting, letter and/or photograph frame with cover, all suitable for mailing as an all-in-one unit, thereby eliminating the need for a separate envelope. In addition, when the unit is reversed upon itself and fastened, the unit becomes a stand exhibiting its content without the need of any additional elements.

11 Claims, 5 Drawing Sheets

FIG. 3
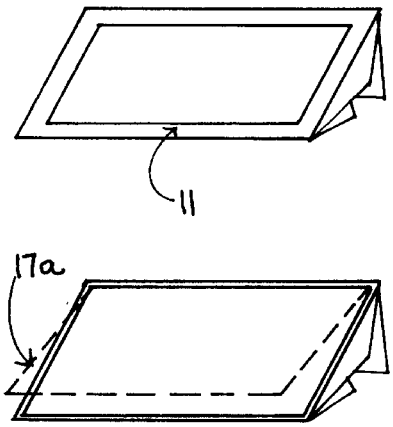
FIG. 4
FIG. 6
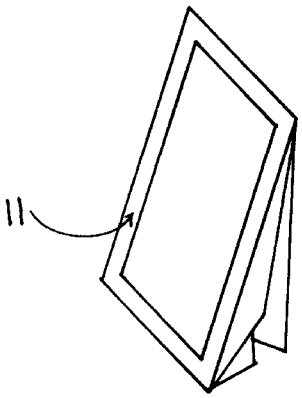
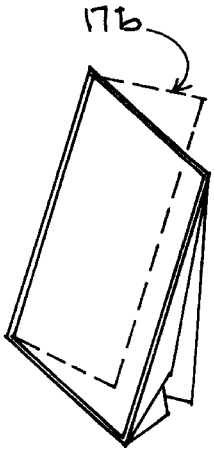
FIG. 7
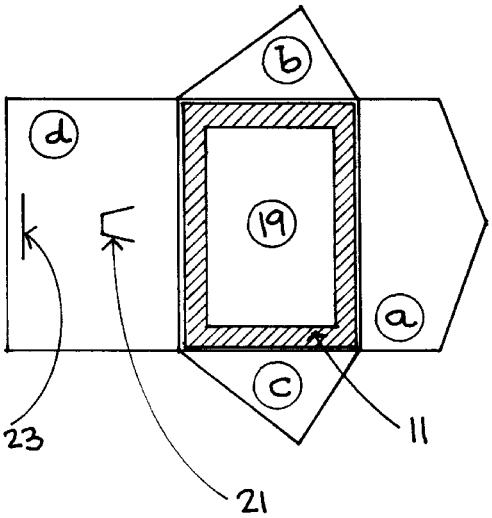
FIG. 5
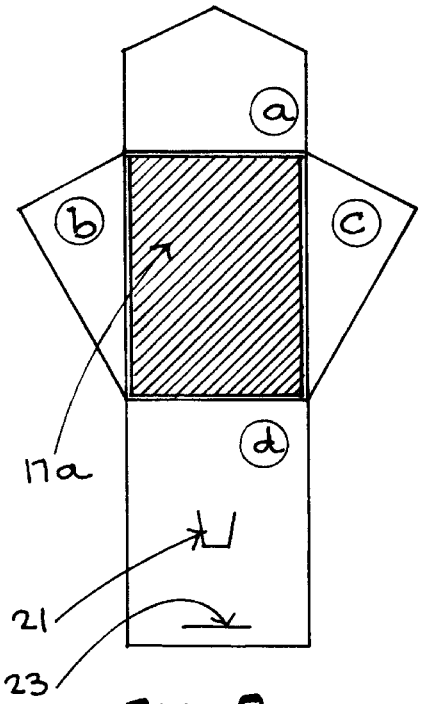
FIG. 8

INSTRUCTIONS

If you just bought your first CHEERUP:
1.Open all flaps and write your message.

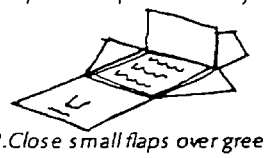

2.Close small flaps over greeting.

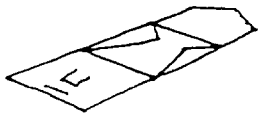

3.Tuck pointy end of flap "a" under tongue cut out of flap "d".
Seal with provided sticker.

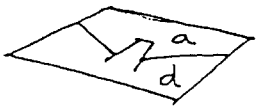

4.Turn it over, write address, apply postage and ship it on its CHEERUP way!

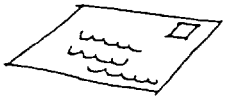

If you just received your first CHEERUP:
1.Open all flaps as shown.

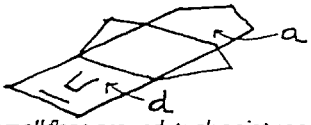

2.Turn small flaps around, tuck pointy end of flap "a" into straight cut out of flap "d".
Stand it up and enjoy!

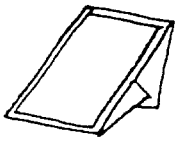

FIG. 11

COMBINATION GREETING CARD PHOTOGRAPH FRAME AND ENVELOPE

BACKGROUND OF THE INVENTION

This invention relates to the field of novelty greeting cards, photograph-holding frames and blank cards, whereas the content portion and the mailing and/or displaying portion form a single unit.

At every holiday throughout the year, people across the country and elsewhere, exchange letters and greetings. When purchasing a card, one might find "the perfect one" only to discover that it is impossible to match an envelope to it. And if an envelope is found, the first thing the receiver does after opening it is to throw away that envelope. The concept of this invention is to eliminate the need for a separate mailing envelope or other container, thereby eliminating the need to search for a suitable one and the waste of paper goods.

SUMMARY OF THE INVENTION

The invention is a self contained, built-in and reversible greeting unit, containing a greeting card with a novelty message, or a photograph-holding frame as a greeting in and of itself, or a blank letter writing portion, all of which are suitable for mailing without the need of any additional envelope or other container.

In addition, when the invention is reversed upon itself and fastened in its unique manner as described therein, it also can be used as a stand to exhibit its content. There is heretofore no known example of such a self-contained greeting product which combines a mailing and display system without the need of discarding anything.

BRIEF DESCRIPTION OF THE DRAWINGS

FIG. 3 shows the invention in an open, horizontal stand-type position, exhibiting the built-in frame in which a purchaser can insert a photograph.

FIG. 4 shows the horizontal stand-type position of the invention, containing a built-in greeting card or a blank page suitable for letter writing.

FIG. 5 is a reduced scale drawing of the horizontal stand-type portion of the invention.

FIG. 6 shows the built-in photograph frame in the vertical stand-type position of the invention.

FIG. 7 shows the built-in greeting or blank page in a vertical stand-type position.

FIG. 8 shows the vertical stand-type portion of the invention drawn at a reduced scale.

FIG. 11 shows an example of an instruction sheet.

DETAILED DESCRIPTION OF THE INVENTION

Figure 1:
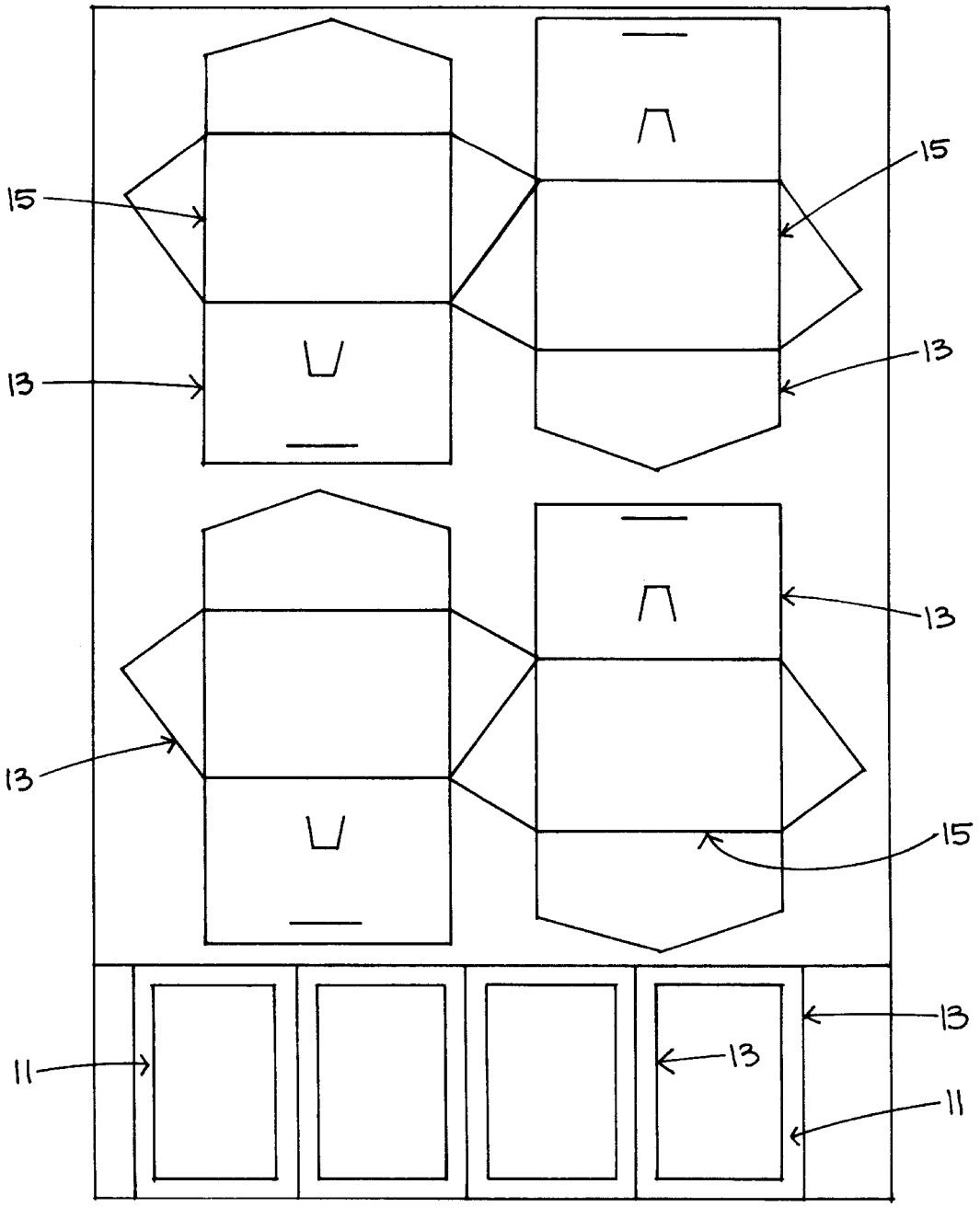
FIG. 1 shows the die cutting pattern for four (4) horizontal units and the die cutting pattern for four (4) built-in photograph frames.
Figure 2:
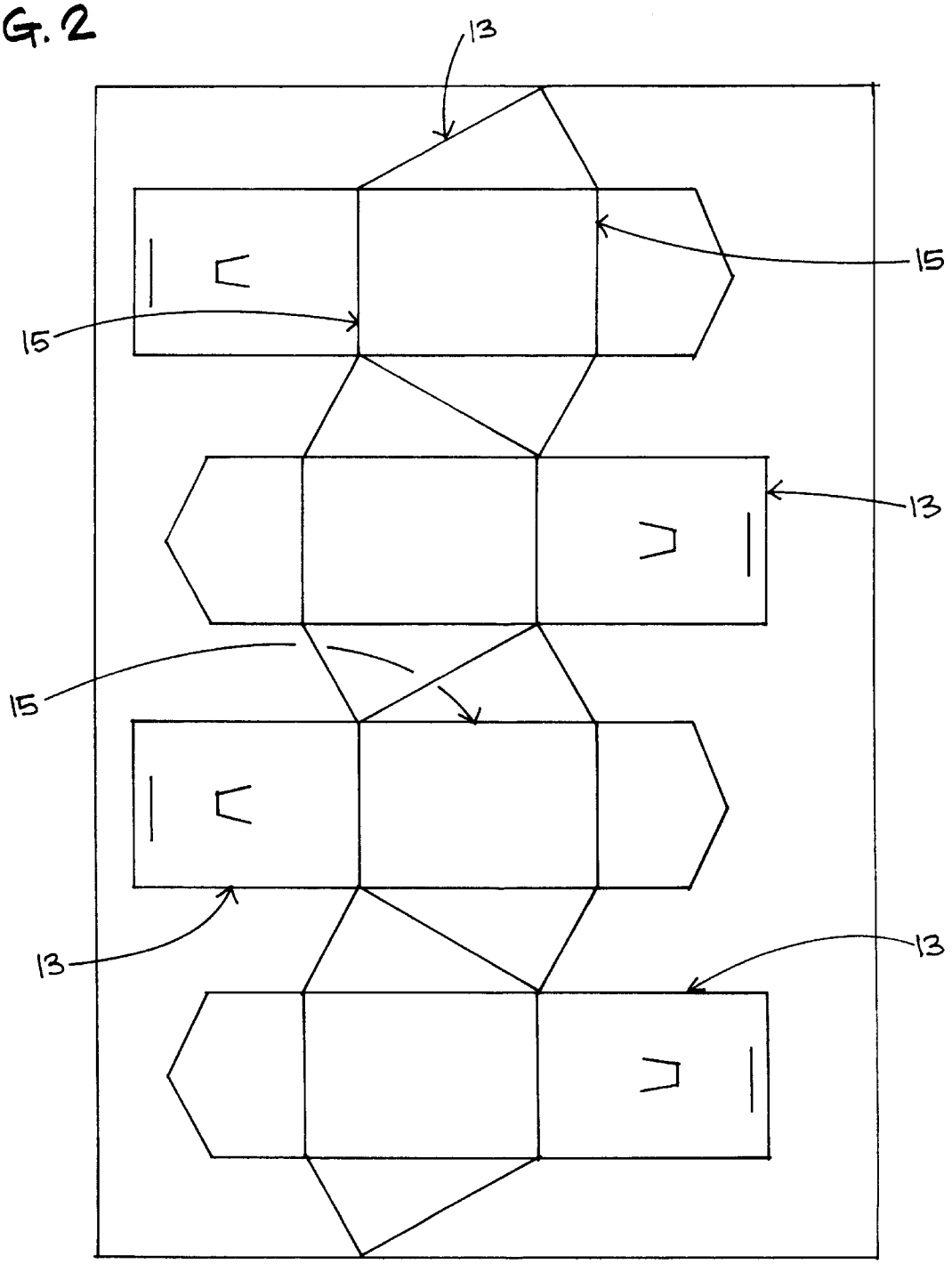
FIG. 2 shows the die cutting pattern for four (4) vertical units.
Figure 9A:
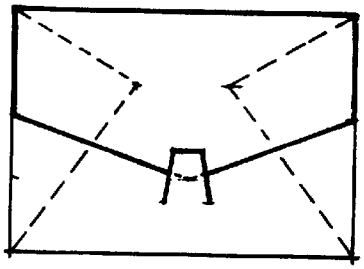
FIG. 9*a* and FIG. 9*b* show the rear view of the horizontal and vertical units respectively, in a closed position, exhibiting each flap visible from the rear view. (Flaps a and d). Also shown, but in dotted lines, are the flaps b and c that are hidden when the unit is in a closed position.
Figure 9B:
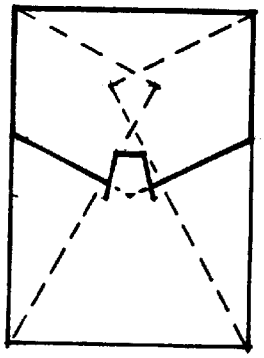

The novelty greeting cards, photograph holding frames and blank cards of the present invention are manufactured utilizing well-known die cutting techniques. Cover stock quality paper is stacked and cut according to a pattern that allows a yield of four horizontal units per sheet of cover stock paper with four photograph frames 11 as shown in FIG. 1 or four (4) vertical units per sheet of cover stock paper as shown in FIG. 2. After the die cutting process is completed according to cut lines 13, each unit is scored upon fold lines 15. Subsequently, the greeting card 17*a*, the blank letter writing page 17*b* or the photograph frame 11 is attached to each of the units as shown in FIGS. 4 or 8, 7 and 5 respectively.

The attachment of the greeting card, the blank letter writing page or the photograph frame to the middle section 19 is preferably made with water-resistant glue. Inserting photographs in frames is well known in the prior art, for example three sides of the photograph frame 11 may be secured to the middle section 19. The photograph may then be inserted into frame 11 through the remaining side.

Each unit is then folded with the greeting card, blank letter writing page or the photograph frame exposed to view.

A small instruction sheet as shown in FIG. 11 is provided with each unit.

Figure 10:
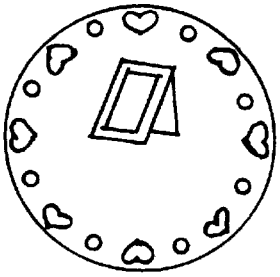
FIG. 10 shows an example of an adhesive sticker for use with the invention.

In addition, a self-adhesive sticker as shown in FIG. 10 which may bear a desired logo may be included with each unit. This sticker is used by the sender to seal the unit prior to mailing.

Preferably, each unit is individually wrapped in protective plastic.

In this manner, the present invention provides both the ability to mail and exhibit its content as a unit.

Referring now to FIGS. 3 through 8, the following are the steps a purchaser would take to use of this invention:

The unit is purchased with the greeting or the blank page or the photograph frame exposed to view as shown in FIGS. 3, 6, 4 and 7.

After the greeting or letter is written or after the photograph is inserted in the frame, the unit is turned face down and flaps "a", "b", "c" and "d" are opened as shown in FIGS. 5 and 8. The part where the addressee's name and address must be written is thereby exposed to view.

After the mailing portion is written and the postage affixed, one must fold the flaps "b" and "c" over the greeting, letter or photograph. The next step is to fold over flap "d" covering the already folded flaps "b" and "c".

The flap "d" is provided with a tongue shaped cutout 21 as shown in FIGS. 5 and 8. This cutout secures in place flap "a", after it is folded over flap "d". A self adhesive sticker as shown in FIG. 10 is provided with each unit and is placed over the tongue shaped cutout, thereby sealing the product for mailing.

The addressee, after removing the self-adhesive sticker, opens the product and can see the simple, illustrative instructions provided, for example, on the reverse of flap "a" or provided with each unit as a small instruction sheet as shown in FIG. 11.

First, the receiver is instructed to fold back flaps "b" and "c". As shown in FIG. 6, when assembled the panels "b" and "c" which can be a visual distraction, are folded between the middle section 19 and flap "a". Next, flap "d" must be turned back and the pointy end of flap "a" must be inserted into the horizontal slot number 23 provided at the bottom of flap "d". The unit with photographs or greeting is ready to be displayed.

It should be understood that the above descriptions disclose specific embodiments of the present invention and are for the purposes of illustration only. There may be other modifications and changes obvious to those of ordinary skill in the art which will fall within the scope of the present invention which should be limited only by the following claims and their legal equivalents.

What is claimed is:

1. A self contained card, envelope and stand comprising:

cover stock paper cut using a predetermined pattern forming five sections, a first one of said sections having a rectangular shape, a second one of said sections adjacent to one edge of said first section, said second section having a rectangular shape, a third one of said sections adjacent to one edge of said second section, said third section having a triangular shape, a fourth one of said sections adjacent to a second edge of said second section, said fourth section having a triangular shape a fifth one of said sections adjacent to a third edge of said second section, said fifth section having five sides, two of which are parallel to each other, one of which is the third edge of the second section, and two of which join said two parallel sides and meet at an obtuse angle to form a point, said cover stock paper having scored lines extending the length of each of said edges, wherein said first section includes a slot parallel to said one edge of said first section and a tongue shaped cutout portion, said point being insertable into said slot for forming a stand and being insertable into said cutout portion for forming an envelope;

wherein when said cover stock paper is assembled into said stand, the point of the fifth section is inserted into the slot of the first section, the third section and fourth section are folded so as to be located between said second section and first section.

2. The card, envelope and stand defined by claim 1 in combination with a greeting card, said greeting card being coupled to said second section.

3. The card, envelope and stand defined by claim 1 in combination with a blank letter, said blank letter being coupled to the second section.

4. A self contained card, envelope and stand comprising:

cover stock paper cut using a predetermined pattern forming five sections, a first one of said sections having a rectangular shape, a second one of said sections adjacent to one edge of said first section, said second section having a rectangular shape, said second section having indicia directly thereon, a third one of said sections adjacent to one edge of said second section, said third section having a triangular shape, a fourth one of said sections adjacent to a second edge of said second section, said fourth section having a triangular shape, a fifth one of said sections adjacent to a third edge of said second section, said fifth section having five sides, two of which are parallel to each other, one of which is the third edge of the second section, and two of which join said two parallel sides and meet at an obtuse angle to form a point, said cover stock paper having scored lines extending the length of each of said edges, wherein said first section includes a slot parallel to said one edge of said first section and a tongue shaped cutout portion, said point being insertable into said slot for forming a stand and being insertable into said cutout portion for forming an envelope.

5. The card, envelope and stand defined by claim 4 wherein said stand displays said indicia in a horizontal position.

6. The card, envelope and stand defined by claim 4 wherein said stand displays said indicia in a vertical position.

7. A self contained photograph frame, envelope and stand comprising:

cover stock paper cut using a predetermined pattern forming five sections, a first one of said sections having a rectangular shape, a second one of said sections adjacent to one edge of said first section, said second section having a rectangular shape, a third one of said sections adjacent to one edge of said second section, said third section having a triangular shape, a fourth one of said sections adjacent to a second edge of said second section, said fourth section having a triangular shape, a fifth one of said sections adjacent to a third edge of said second section, said fifth section having five sides, two of which are parallel to each other, one of which is the third edge of the second section, and two of which join said two parallel sides and meet at an obtuse angle to form a point, said cover stock paper having scored lines extending the length of each of said edges, wherein said first section includes a slot parallel to said one edge of said first section and a tongue shaped cutout portion, said point being insertable into said slot for forming a stand and being insertable into said cutout portion for forming an envelope;

said cover stock paper being further cut using a second predetermined pattern forming a frame, said frame substantially fitting within the edges of said second section, said frame having a plurality of sides, at least one of said plurality of sides coupled to said second section;

wherein when said cover stock paper is assembled into said stand, the point of the fifth section is inserted into the slot of the first section, the third section and fourth section are folded so as to be located between said second section and first section.

8. The photograph frame, envelope and stand defined by claim 7 wherein said stand displays said frame in a horizontal position.

9. The photograph frame, envelope and stand defined by claim 7 wherein said stand displays said frame in a vertical position.

10. A self-contained card, envelope and stand comprising:

cover stock paper cut using a predetermined pattern forming five sections, a first one of said sections having a rectangular shape, a second one of said sections adjacent to one edge of said first section, said second section having a rectangular shape, a top side and a bottom side a third one of said sections adjacent to one edge of said second section, said third section having a triangular shape, a fourth one of said sections adjacent to a second edge of said second section, said fourth section having a triangular shape, a fifth one of said sections adjacent to a third edge of said second section, said fifth section having five sides, two of which are parallel to each other, one of which is the third edge of the second section, and two of which join said two parallel sides and meet at an obtuse angle to each of said edges, wherein said first section includes a slot parallel to said one edge of said first section and a tongue shaped cutout portion, said point being insertable into said slot for forming a stand and being insertable into said cutout portion for forming an envelope;

said cover stock paper capable of being selectively assembled into said envelope by placing said third section and said fourth section on said top side of said second section and inserting said point into said cutout portion wherein said fifth section and said first section are folded toward said top side of said second section;

said cover stock paper capable of being selectively assembled into said stand wherein the point of the fifth section is inserted into the slot of the first section, said first and fifth sections folded toward said bottom side of said second section and the third and fourth section being folded so as to be located between said second section and first section.

11. The card, envelope and stand defined by claim 10 wherein said second section includes indicia.

* * * * *